US006145266A

United States Patent [19]

VonDross

[11] Patent Number: 6,145,266

[45] Date of Patent: Nov. 14, 2000

[54] VERTICAL AND HORIZONTAL BELT MASONRY SYSTEM

[75] Inventor: Kerry L. VonDross, Waukesha, Wis.

[73] Assignee: Best Block Company, Butler, Wis.

[21] Appl. No.: 09/193,579

[22] Filed: Nov. 17, 1998

[51] Int. Cl.[7] ..... E04B 5/04

[52] U.S. Cl. ..... 52/604; 52/311.2; 52/606

[58] Field of Search ..... 52/604–607, 596, 52/311.1, 311.2

[56] References Cited

U.S. PATENT DOCUMENTS

| | | | |
|---|---|---|---|
| 415,773 | 11/1889 | Fiske . | |
| 1,086,975 | 2/1914 | Aaronson . | |
| 1,534,353 | 4/1925 | Besser . | |
| 1,872,522 | 8/1932 | Stuckey . | |
| 2,957,278 | 10/1960 | Woodworth . | |
| 5,078,940 | 1/1992 | Sayles . | |
| 5,161,918 | 11/1992 | Hodel | 52/605 |
| 5,622,456 | 4/1997 | Risi et al. | 52/604 |
| 5,848,511 | 12/1998 | Scales | 52/606 |

FOREIGN PATENT DOCUMENTS 0 289 643 11/1988 European Pat. Off. .

OTHER PUBLICATIONS

"Best Stone & Best Stone Boss", Best Block Company brochure, 1–94.

*Primary Examiner*—Beth A. Stephan
*Attorney, Agent, or Firm*—Andrus, Sceales, Starke & Sawal, LLP

[57] ABSTRACT

A masonry system including three types of different individual masonry blocks that can be stacked to form recessed horizontal and vertical belts in a wall formed from the masonry blocks. The masonry system includes a horizontal block having a decorative band extending horizontally along a front face surface of the horizontal block. The horizontal decorative band is recessed from the front face surface. The masonry system further includes a vertical block having a decorative band extending vertically in the front face surface of the vertical block. The vertical decorative band is recessed from the front face surface. The masonry system further includes an intersect block having both a horizontal decorative band and a vertical decorative band joined to each other. The intersect block can be positioned to provide the required transition between horizontal and vertical belts formed in a wall assembled by using the masonry system of the present invention.

15 Claims, 2 Drawing Sheets

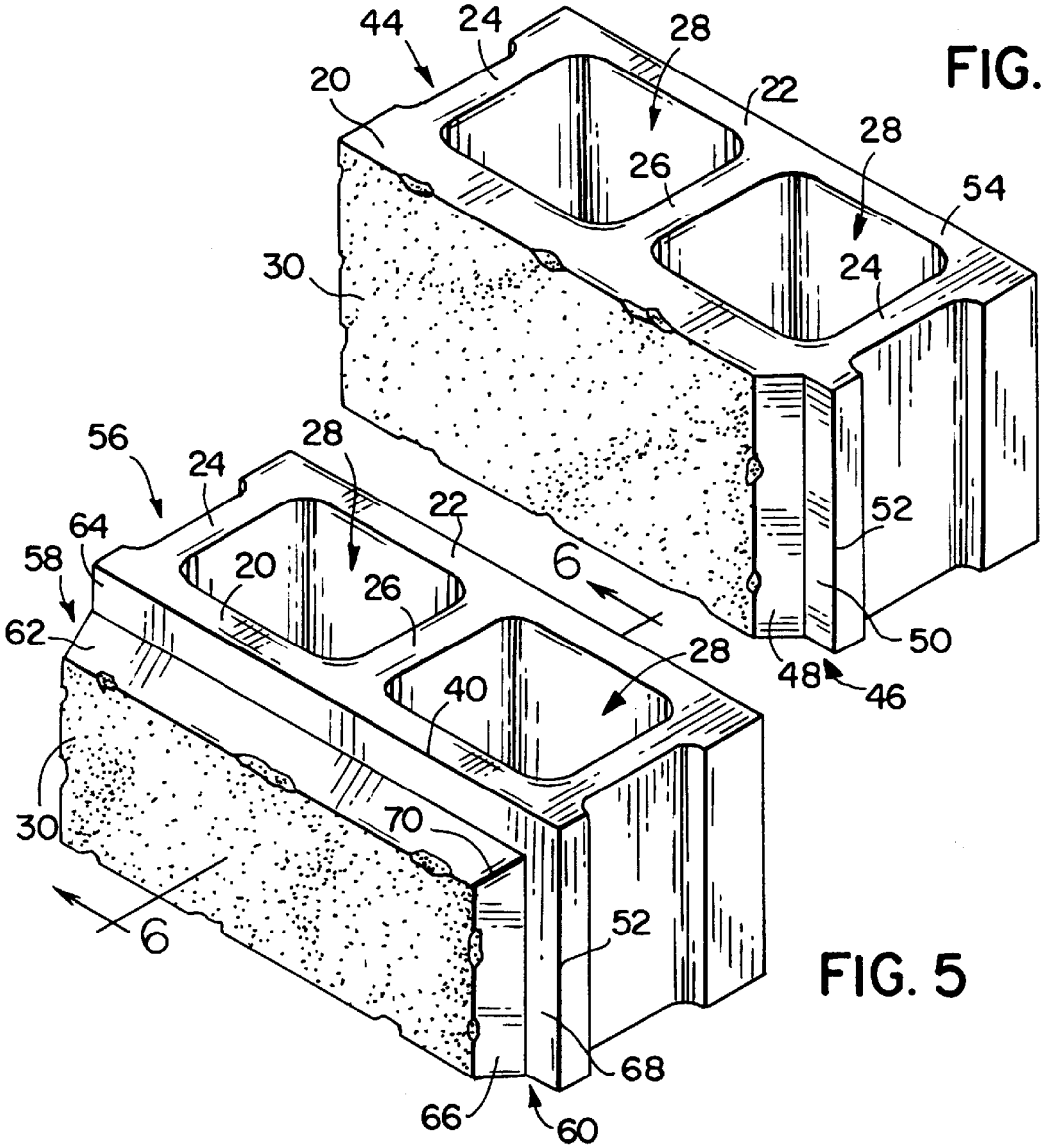
FIG. 4
FIG. 5
FIG. 7
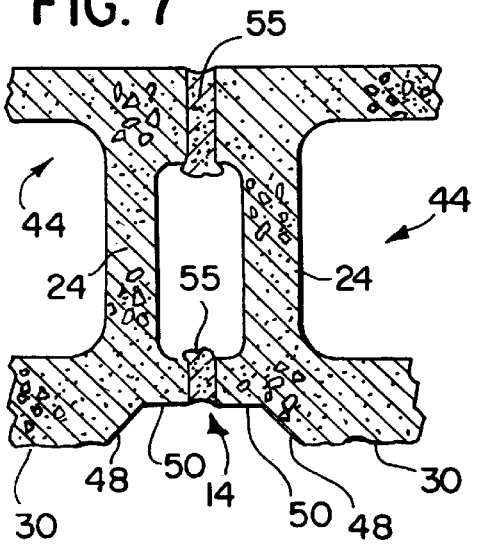
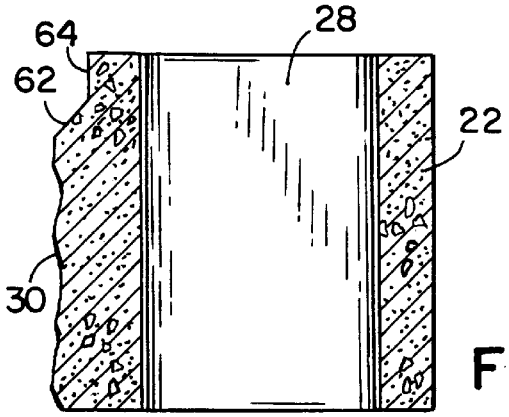
FIG. 6

VERTICAL AND HORIZONTAL BELT MASONRY SYSTEM

BACKGROUND OF THE INVENTION

The present invention relates to a masonry system that allows a decorative design to be formed in a wall constructed of individual masonry blocks. More specifically, the present invention relates to a masonry system including at least three specifically designed masonry blocks that can be strategically positioned during the construction of a wall to form a decorative design in the wall.

The outer walls of many buildings are constructed from either individually stacked masonry blocks or precast concrete slabs. A building constructed from stacked masonry blocks provides design and construction advantages, since stacked masonry blocks can be assembled in unlimited configurations to provide greater flexibility in the design of the building and reduced building material costs. However, in a building having a large wall, conventional masonry blocks that have a generally smooth face surface create a stark, unattractive, smooth wall surface that is often undesirable to the architect designing the building. For this reason, precast concrete slabs are often chosen because of the large number of patterns that can be formed in the precast slabs.

Different types of masonry block have been developed to provide architects with greater flexibility in designing the overall outside and/or inside appearance of a building constructed from masonry block. For example, masonry blocks have been developed having an extended front face surface relative to the other blocks used in the building, thereby allowing the architect to create protruding horizontal bands that extend across the walls of the building. Additionally, masonry blocks having a series of vertical flutes have been designed to allow architects to design a building having vertical columns or grooves formed in its walls.

While these types of masonry blocks provide architects with a greater degree of flexibility in designing the outside appearance of a building formed from masonry block, the advent of precast concrete slabs has increased the number of designs that can be formed on the outer facade of a building. However, precast concrete slabs increase the cost of a building and limit the size and types of designs available for the architect, since the size of the building must be made in multiples of the concrete slab dimensions. Additionally, the type of design chosen must be selected from a catalog determined by the concrete slab manufacturer.

Therefore, it is an object of the present invention to provide a masonry system that allows an architect or designer to form a pattern in the outer facade of a building constructed from stacked masonry block. It is an additional object of the invention to provide a masonry system that allows both horizontal and vertical belts to be formed in the facade of the building. It is a further object of the invention to provide a masonry system that includes individual masonry blocks that allow the horizontal and vertical belts to be joined at corners. It is a further object of the invention to provide a masonry system including vertical blocks that have a decorative band formed in the front face surface of the block that extends in the vertical direction. It is a further object of the invention to provide a horizontal block having a decorative band extending horizontally along the front face surface of the block. Additionally, it is an object of the invention to provide an intersect block having decorative bands extending in both the horizontal and vertical direction along the front face of the block.

Still further, it is an object of the present invention to provide an intersect block that allows for a horizontal to vertical transition between the horizontal decorative band on the horizontal block and the vertical decorative band on the vertical block of the masonry system. It is still a further object of the invention to provide a masonry system in which the decorative band on each of the blocks includes a chamfer angled inward from the front face surface. It is a further object of the invention to provide a decorative band on each type of masonry block that includes a generally flat outer edge surface positioned either between the chamfer and an outer edge of the respective masonry block or the front face surface and the chamfer of the block.

SUMMARY OF THE INVENTION

The present invention is a masonry system including three distinct types of masonry block that, when positioned and oriented correctly, can create a recessed pattern in an otherwise smooth wall surface. The first type of masonry block is a vertical block that has a generally planar front face surface. The front face surface includes a decorative band extending vertically through the front face surface. Specifically, the decorative band is recessed from the front face surface and extends along one of the side edges of the front face surface. More specifically, the decorative band includes a chamfer angled inward from the front face surface to the side edge of the block. The decorative band can also include an outer edge surface extending between the chamfer and the side edge of the vertical block. The outer edge surface is included in a plane recessed from and generally parallel to the plane of the front face surface. Thus, the outer edge surface is recessed from the front face surface by the chamfer.

A second type of masonry block is a horizontal block that includes a decorative band extending horizontally through the generally planar front face surface of the horizontal block. Specifically, the decorative band is recessed from the front face surface and extends along the top edge of the block. The decorative band includes a chamfer angled inward from the front face surface of the horizontal block. Additionally, the decorative band can include an outer edge surface positioned between the top edge of the block and the chamfer. The outer edge surface is included in a plane recessed from and generally parallel to the plane of the front face surface. Thus, the outer edge surface is recessed from the front face surface by the chamfer.

A third type of masonry block, referred to as an intersect block, includes both a horizontal decorative band and a vertical decorative band. The horizontal and vertical decorative bands meet in one corner of the intersect block. The horizontal band is identical to the horizontal decorative band on the horizontal block, while the vertical band on the intersect block is identical to the vertical decorative band on the vertical block. In this manner, the intersect block can be positioned such that the horizontal and vertical decorative bands join the corresponding decorative bands included on properly aligned horizontal and vertical blocks. In this manner, a combination of the vertical block, the horizontal block, and the intersect block allows horizontal and vertical belts to be formed and joined in a desired pattern along an otherwise smooth wall.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 4 is a perspective view of a vertical block of the masonry system incorporating a vertical decorative band;

FIG. 5 is a perspective view of an intersect block of the masonry system incorporating both a horizontal decorative band and a vertical decorative band;

FIG. 6 is a section view taken along line 6—6 in FIG. 5 illustrating the configuration of the horizontal decorative band of the intersect block shown in FIG. 5; and FIG. 7 is a partial section view taken along line 7—7 of FIG. 1 illustrating a pair of vertical blocks positioned to form a vertical belt.

DETAILED DESCRIPTION OF THE INVENTION

Figure 1:
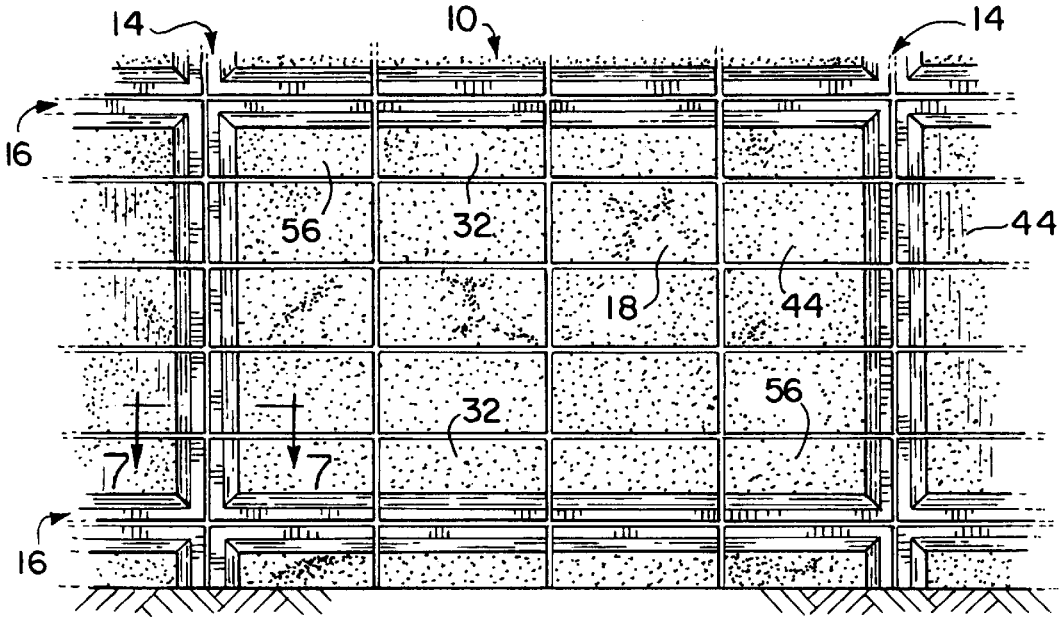
FIG. 1 is a front view of a wall including both horizontal and vertical belts constructed using a masonry system of the present invention.

FIG. 1 illustrates a wall 10 constructed using the masonry system of the present invention. The portion of the wall 10 shown in FIG. 1 is constructed from a plurality of individual masonry blocks stacked and secured together in a stack bond configuration using conventional masonry techniques. In a wall constructed using the stack bond technique, the individual blocks are vertically aligned in individual rows as shown in FIG. 1. Although not shown, the masonry system of the present invention could also be utilized in a wall constructed in a running bond configuration in which the blocks in adjacent horizontal rows overlap the blocks in the rows positioned above and below.

The masonry system of the present invention can be used to form the wall 10 having decorative belts formed in the otherwise smooth outer surface of the wall 10. As shown in FIG. 1, the wall 10 includes a pair of vertical belts 14 and a pair of horizontal belts 16. The vertical and horizontal belts 14 and 16 are each recessed from the otherwise planar facade of the wall 10. The vertical and horizontal belts 14 and 16 break up the otherwise smooth, planar facade of the wall 10. In constructing the wall 10 shown in FIG. 1, four types of individual masonry blocks are utilized to form the decorative pattern. These blocks are illustrated in FIGS. 2–5, and a detailed discussion of each is set out below.

Figure 2:
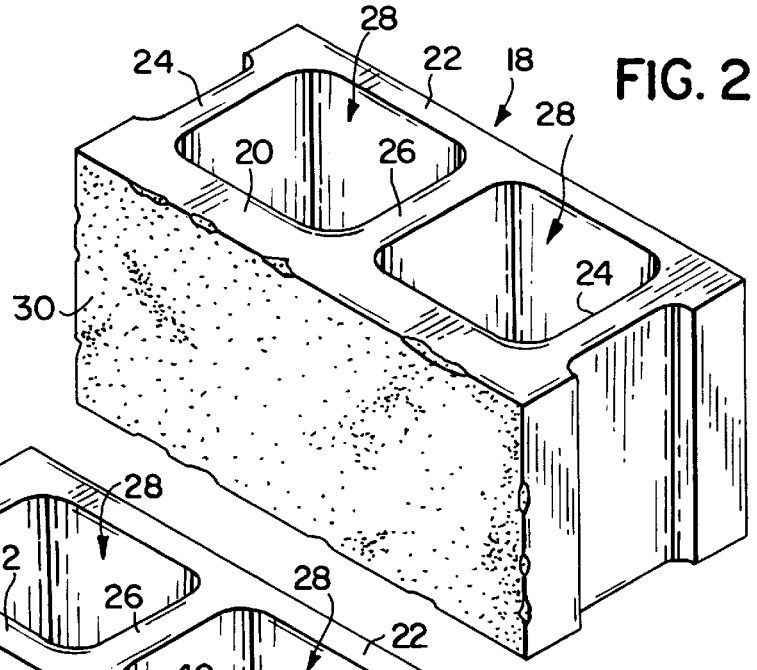
FIG. 2 is a perspective view of a conventional split face masonry block.

FIG. 2 illustrates a conventional split face masonry block 18 presently utilized to form walls having a substantially planar outer facade. The masonry block 18 is formed from a concrete material and has a front wall 20, a back wall 22, and a pair of sidewalls 24. A center web 26 extends between the front wall 20 and the back wall 22 to define a pair of internal cavities 28. The internal cavities 28 provide spacing between the front wall 20 and the back wall 22. The spacing between the front wall 20 and the back wall 22 dictates the width of the masonry block 18. Typically, the masonry block 18 is commercially available in several different widths, thus increasing the flexibility of the types of walls 10 that can be formed from the individual masonry blocks.

Masonry block 18 shown in FIG. 2 includes a generally planar decorative front face surface 30 contained on the outer surface of the front wall 20. The decorative front face surface 30 includes a rough, textured surface that forms the exterior of a wall constructed from the individual masonry blocks 18. Alternatively, the front face surface 30 could be a smooth surface. As shown in FIG. 2, the thickness of the front wall 20 is greater than the thickness of the back wall 22. Specifically, the front wall 20 is ¾ of an inch thicker than the back wall 22. The thickness of the back wall 22 is the thickness required to provide structural strength and stability for the masonry block 18, while the expanded thickness of the front wall 20 allows the front face surface 30 to be configured as will be discussed below. The split face masonry block 18 having an extended front wall 20, as shown in FIG. 2, is currently available under the product name "Best Stone Boss", available from Best Block Company, Butler, Wis.

Figure 3:
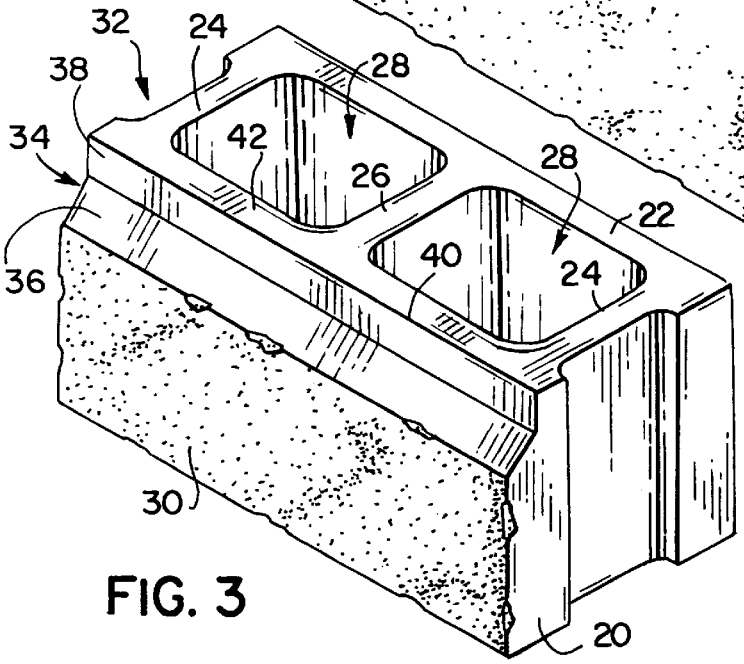
FIG. 3 is a perspective view of a horizontal block of the masonry system incorporating a horizontal decorative band.

Referring now to FIGS. 3–5, thereshown are three individual masonry blocks that combine to form the masonry system of the present invention. When combined with the split face masonry block 18 shown in FIG. 2, the masonry blocks shown in FIGS. 3–5 can form the wall 10 shown in FIG. 1 and create the vertical belts 14 and one or more horizontal belts 16.

Referring first to FIG. 3, thereshown is a horizontal block 32 that forms part of the masonry system of the present invention. The horizontal block 32 contains many of the same structural features as the split face masonry block 18 shown in FIG. 2, and like reference numerals are used to facilitate understanding. The horizontal block 32 includes the generally planar front face surface 30 contained on the front wall 20. As was the case with the split face masonry block 18, the thickness of the front wall 20 is greater than the thickness of the back wall 22. In the preferred embodiment of the invention, the front wall 20 has a thickness approximately ¾ of an inch greater than the thickness of the back wall 22.

As shown in FIG. 3, the horizontal block 32 includes a decorative band 34 extending horizontally along the front face surface 30. Specifically, the decorative band 34 includes a chamfer 36 angled inward into the thickness of the front wall 20 from the generally planar front face surface 30. In the preferred embodiment of the invention, the chamfer 36 angles inward relative to the vertical plane containing the front face surface 30 at an angle of approximately 37°.

In the preferred embodiment of the invention shown in FIG. 3, an outer edge surface 38 is positioned between the chamfer 36 and top edge 40 of the horizontal block 32. As can be understood in FIG. 3, the outer edge surface 38 is contained in a generally vertical plane that is parallel to and recessed from the generally vertical plane including the front face surface 30. In the preferred embodiment of the invention, the width of the outer edge surface 38 is approximately one inch, although other widths are contemplated as being within the scope of the invention. Additionally, the outer edge surface 50 is preferably recessed ¾ of an inch from the front face surface 30.

The thickness of the front wall 20 is reduced near the top edge 40 of the horizontal block 32 due to the decorative band 34. However, the thickness of the front wall 20 behind the outer edge surface 38, as illustrated along upper surface 42, is approximately equal to the width of the back wall 22. Since the front wall 20 is expanded by approximately ¾ of an inch relative to the back wall 20, the removal of material from the front face surface 30 to create the decorative band 34 leaves enough structural material in the top of the front wall 20 such that the front wall 20 retains its required structural strength. Additionally, as can be understood in FIG. 3, the upper surface 42, with the decorative band 34 formed in the front face surface 30, has the conventional shape and configuration of standard masonry blocks currently available, such that the horizontal block 32 can be used in connection with conventional masonry blocks that are commercially available.

Referring now to FIG. 1, it can be understood that the horizontal belts 16 formed in the stack bond wall 10 are constructed by using pairs of aligned horizontal blocks 32 stacked on top of each other. Each horizontal belt 16 is created by the decorative bands 34 contained on the stacked horizontal blocks 32. To form each horizontal band 16, a first horizontal block 32 is oriented in the upright position as shown in FIG. 3 with the decorative band 34 positioned near the top end of the horizontal block 32. After the horizontal block 32 is positioned as such, a second horizontal block 32 is inverted such that the decorative band 34 is positioned near the bottom edge of the horizontal block 32. The inverted horizontal block 32 is then stacked above and secured to the first horizontal block 32 by conventional masonry techniques, such as mortar, to form a portion of the horizontal belt 16. Numerous pairs of horizontal blocks 32 are aligned next to each other to form the length of the horizontal belt 16.

Although the horizontal block 32 is shown and described as having a decorative band 34 including both the chamfer 36 and the outer edge surface 38, it is contemplated by the inventor that the decorative band 34 could include only the chamfer 36. In this type of configuration, the chamfer 36 would angle toward the interior of the horizontal block 32 from the front face surface 30 to the top edge 40. Additionally, it is contemplated that the smooth outer edge surface could be formed between the chamfer 36 and the front face surface 30, rather than between the chamfer 36 and the top edge 40.

Referring now to FIG. 4, thereshown is a vertical block 44 that forms part of the masonry system of the present invention. The vertical block 44 includes many of the same structural features as the split face masonry block 18 shown in FIG. 2, and like reference numerals are used to facilitate understanding. The vertical block 44 includes a decorative band 46 extending vertically along its front face surface 30. The decorative band 46 formed in the vertical block 44 includes a chamfer 48 angled inward from the generally planar front face surface 30. In the preferred embodiment of the invention, the chamfer 48 extends inward from the generally vertical plane including the front face surface 30 at an angle of approximately 37°.

In the preferred embodiment of the invention, the decorative band 46 further includes an outer edge surface 50 positioned between the chamfer 48 and side edge 52 of the vertical block 44. The outer edge surface 50 is generally included in a vertical plane that is parallel to and recessed from the generally vertical plane that includes the front face surface 30. In the preferred embodiment of the invention, the width of the outer edge surface 50 is approximately one inch, although other widths are contemplated as being within the scope of the invention. Additionally, the outer edge surface 50 is preferably recessed ¾ of an inch from the front face surface 30.

As can be understood in FIG. 4, upper surface 54 of the vertical block 44 retains a conventional configuration even though the decorative band 46 has been removed from the front wall 20. As previously discussed, the front wall 20 has a width greater than the back wall 22, such that removing a portion of the front wall 20 to form the decorative band 46 allows sufficient material to remain in the front wall 20 to provide the required structural stability for the vertical block 44.

Referring now to FIGS. 1 and 7, it can be seen that a pair of adjacent vertical blocks 44 are used to create a portion of each vertical belt 14 extending through wall 10. As can be seen in FIG. 7, the leftmost vertical block 44 is positioned in the manner shown in FIG. 4, such that the decorative band 46 is included along the rightmost edge of the front face surface 30. With the first vertical block 44 positioned as shown, a second vertical block 44 is inverted such that the decorative band 46 now is positioned along its leftmost edge. With the second vertical block 44 inverted, the vertical block 44 is positioned adjacent to the first vertical block to form the vertical belt 14 as shown. The adjacent decorative bands 46, and specifically the adjacent outer edge surfaces 50, form the vertical belt 14 that is recessed from the front face surface 30 of each block. A line of mortar 55 is positioned between adjacent vertical blocks 44 to secure the blocks in a conventional manner.

Although the vertical block 44 is shown and described as having a decorative band 46 including both the chamfer 48 and the outer edge surface 50, it is contemplated by the inventor that the decorative band 46 could be modified to include only the chamfer 48. In this modified condition, the chamfer 48 would extend from the front face surface 30 directly to the side edge 52 without the inclusion of the outer edge surface 50. Additionally, it is contemplated that the smooth outer edge surface 50 could be formed between the chamfer 36 and the front face surface 30, rather than between the chamfer 48 and the side edge 52.

FIG. 5 shows the final type of masonry block of the masonry system of the present invention, called an intersect block 56. As was the case with both the horizontal block 32 and the vertical block 44, the intersect block 56 includes generally identical structural features to the split face masonry block 18 shown in FIG. 2, such that like reference numerals are used to facilitate understanding. The intersect block 56 includes a first decorative band 58 and a second decorative band 60, each formed in the front face surface 30. The first decorative band 58 extends horizontally along the front face surface 30 and includes a chamfer 62 and an outer edge surface 64. The first decorative band 58 is configured to be identical to the decorative band 34 (FIG. 3) included on the horizontal block 32. In this manner, the intersect block 56 can be positioned adjacent to the horizontal block 32 and continue the horizontal belt 16, as understood in FIG. 1.

In addition to the first decorative band 58, the intersect block 56 includes the second decorative band 60. The second decorative band 60 extends vertically along one side of the intersect block 56. The second decorative band 60 includes a chamfer 66 and an outer edge surface 68. The second decorative band 60 is configured to be identical to the decorative band 46 (FIG. 4) contained on the vertical block 44. In this manner, the intersect block 56 can be positioned on top of or below one of the vertical blocks 44 to continue the vertical belt 14 formed in the wall 10, as shown in FIG. 1. As can be seen in FIG. 5, the chamfer 62 of the first decorative band 58 and the chamfer 66 of the second decorative band 60 are joined at a corner 70. As can best be understood in FIG. 1, the corner 70 provides a transition point between the vertical belt 14 and the horizontal belt 16, such that joined patterns of vertical and horizontal belts can be formed in the wall 10 by using the intersect block 56.

As can be understood in FIG. 1, the intersect block 56 can be used in the orientation shown in FIG. 5, or can be inverted such that the corner 70 is located in the lower left corner of the inverted intersect block 56. Additionally, a second type of intersect block (not shown) is also used to form the pattern shown in FIG. 1. The second type of intersect block includes the second decorative band 60 formed in the left edge of the intersect block, rather than the right edge as shown in FIG. 5. In this configuration, the corner 70 would be positioned near the upper left corner of the second type of intersect block. By using the two types of intersect blocks as discussed, four individual intersect blocks 56 can be configured to form the horizontal to vertical connection between the vertical belt 14 and the horizontal belt 16, as shown in FIG. 1.

Although the intersect block 56 has been shown and described as having the first decorative band including both the chamfer 62 and the outer edge surface 64, and the second decorative band 60 as having both the chamfer 66 and the outer edge surface 68, it is contemplated by the inventors that both of these decorative bands could be modified to include only the chamfers 62 and 66. In this type of modified intersect block 56, the chamfer 62 would extend directly from the front face surface 30 to the top edge 40, while the second chamfer 66 would extend directly from the front face surface 30 to the side edge 52. Additionally, it is contemplated that the smooth outer edge surfaces 64 and 68 could be formed between the front face surface 30 and the respective chamfer 62 or 66 rather than between the chamfer 62 or 66 and the top edge 40 or side edge 52.

As can be understood by the previous description, the masonry system of the present invention can be used to construct walls having vertical and horizontal belts formed in what would otherwise have been a generally flat, smooth outer surface. The design shown in FIG. 1 merely represents one of an unlimited number of decorative designs that could be formed in a wall constructed from the three individual types of masonry blocks that are included in the masonry system of the present invention. Additionally, the three individual masonry blocks could be slightly modified such that a decorative pattern could be formed in a wall constructed using a running bond configuration. Specifically, half vertical and intersect blocks would be constructed so that these blocks could complete the vertical bands formed in the wall constructed with overlapping blocks.

The masonry system of the present invention provides architects and building designers with the flexibility to simply substitute the masonry blocks shown and described in the invention for conventional masonry blocks and thus utilize the masonry system to form decorative patterns in the outer facade of a building. Additionally, since the masonry blocks of the masonry system of the present invention retain the size characteristics of conventional commercially available masonry blocks, architects and building designers can revise proven building designs without any additional design considerations.

Various alternatives and embodiments are contemplated as being within the scope of the following claims particularly pointing out and distinctly claiming the subject matter regarded as the invention.

I claim:

1. A masonry system comprising:

a vertical block having a front face surface defined by a pair of opposed side edges, a top edge and a bottom edge, the vertical block including only a single decorative band recessed from the front face surface and extending vertically along one side edge of the vertical block;

a horizontal block having a front face surface defined by a pair of opposed side edges, a top edge and a bottom edge, the horizontal block including only a single decorative band recessed from the front face surface and extending horizontally along the top edge of the horizontal block; and an intersect block having a front face surface defined by a pair of opposed side edges, a top edge and a bottom edge, the intersect block including only a first decorative band recessed from the front face surface and extending horizontally along the top edge of the intersect block surface and a second decorative band recessed from the front face surface and extending vertically along one side edge of the intersect block, wherein a plurality of vertical blocks, horizontal blocks and intersect blocks can be aligned to create a pattern in a wall constructed from a plurality of stacked blocks.

2. The masonry system of claim 1 wherein the first decorative band and the second decorative band on the intersect block are joined by a corner portion.

3. The masonry system of claim 1 wherein the decorative bands on the vertical, horizontal and intersect blocks each include a chamfer that angles from the front face surface of the block toward the center of the block.

4. The masonry system of claim 3 wherein the decorative bands on each of the vertical, horizontal and intersect blocks each include an outer edge surface positioned between the chamfer and an edge of the vertical, horizontal and intersect block, the outer edge surface being recessed from and generally parallel to the front face surface of the vertical, horizontal and intersect block.

5. The masonry system of claim 4 wherein the width of the outer edge surfaces contained on the vertical, horizontal and intersect blocks are equal.

6. A method of forming a pattern in a wall constructed from a plurality of masonry blocks, the method comprising the steps of:

providing a vertical block having only a single decorative band formed in a front face surface of the horizontal block, the decorative band extending in a first direction in the front face surface of the vertical block;

providing a horizontal block having only a single decorative band formed in a front face surface of the horizontal block, the decorative band extending in a second direction perpendicular to the first direction in the front face surface of the horizontal block;

providing an intersect block having only a first decorative band extending in the first direction in a front face surface of the intersect block and a second decorative band extending in the second direction in the front face surface of the intersect block;

aligning a plurality of vertical blocks such that the decorative bands on adjacent vertical blocks form a continuous first belt extending in the first direction;

aligning a plurality of horizontal blocks such that the decorative bands on adjacent horizontal blocks form a continuous second belt extending in the second direction; and positioning at least one of the intersect blocks at the intersection between the first belt and the second belt, such that the first and second decorative bands on the intersect block join the first and second belts.

7. The method of claim 6 wherein the decorative bands on the vertical block, horizontal block, and intersect block are each recessed from the front face surface of the block.

8. The method of claim 6 wherein the step of forming the continuous first belt includes the steps of:

stacking a first column of vertical blocks in an upright position such that the decorative bands on each of the stacked vertical blocks are vertically aligned; and stacking a second column of vertical blocks adjacent to the first column of vertical blocks, each of the vertical blocks in the second column being inverted from the upright position such that the decorative bands on each of the stacked vertical blocks of the second column are vertically aligned, and the decorative band on each vertical block in the second column is positioned adjacent to the decorative band on one of the vertical blocks in the first column positioned adjacent thereto.

9. The method of claim 8 wherein the step of forming the continuous second belt includes the steps of:

aligning a first row of horizontal blocks in an upright position such that the decorative bands on the horizontal blocks are positioned near the top of the horizontal block and are aligned with each other; and aligning a second row of horizontal blocks above the first row of horizontal blocks, each horizontal block in the second row being inverted from the upright position such that the decorative band on each horizontal block in the second row is positioned at the bottom of the horizontal block, wherein the decorative band of each horizontal block in the second row is positioned above the decorative band of the horizontal block contained in the first row positioned immediately therebelow.

10. A masonry system for creating a pattern in a wall constructed from a plurality of masonry blocks, the system comprising:

a first masonry block having a front face surface defined by a pair of opposed side edges, a top edge and a bottom edge, the first masonry block including only a single decorative band recessed from the front face surface along one side edge of the block;

a second masonry block having a front face surface defined by a pair of opposed side edges, a top edge and a bottom edge, the second masonry block including only a single decorative band recessed from the front face surface along the top edge of the block; and a third masonry block having a front face surface defined by a pair of opposed side edges, a top edge and a bottom edge, the third masonry block including only a first decorative band and a second decorative band each recessed from the front face surface, the first decorative band extending along only one side edge of the block and the second decorative band extending along only the top edge of the block;

wherein a plurality of the first masonry blocks can be aligned such that the decorative bands form a vertical belt, and a plurality of the second masonry blocks can be aligned such that the decorative bands form a horizontal belt, and at least one of the third masonry blocks can be positioned to join the horizontal belt and the vertical belt.

11. The masonry system of claim 10 wherein the decorative bands formed in the first, second and third masonry block each include a chamfer recessed from the front face surface of the respective block.

12. The masonry system of claim 9 wherein the decorative bands of the first, second and third masonry block each include an outer edge surface extending between the chamfer and an edge of the block, the outer edge surface being generally planar to and recessed from a vertical plane containing the front face surface.

13. A masonry system comprising:

a vertical block having a back wall and a front wall including a front face surface defined by a pair of opposed side edges, a top edge and a bottom edge, the front face surface including a single decorative band extending vertically along the front face surface and positioned adjacent to only one side edge of the vertical block, the decorative band including a chamfer angled inward into the front wall from the front face surface and an outer edge surface positioned between the chamfer and the side edge of the vertical block;

a horizontal block having a back wall and a front wall including a front face surface defined by a pair of opposed side edges, a top edge and a bottom edge, the front face surface including a single decorative band extending horizontally along the front face surface and positioned adjacent to the top edge of the horizontal block, the decorative band including a chamfer angled inward into the front wall from the front face surface and an outer edge surface positioned between the chamfer and the top edge of the horizontal block; and an intersect block having a back wall and a front wall including a front face surface defined by a pair of opposed side edges, a top edge and a bottom edge, the front face surface including a single horizontal decorative band extending horizontally along the front face surface and positioned adjacent to the top edge of the intersect block, the horizontal decorative band including a chamfer angled inward into the front wall from the front face surface and an outer edge surface positioned between the chamfer and the top edge of the block, and a single vertical decorative band extending vertically along the front face surface and positioned adjacent to only one side edge of the intersect block, the vertical decorative band including a chamfer angled inward into the front wall from the front face surface and an outer edge surface positioned between the chamfer and the side edge of the block, wherein a plurality of vertical blocks, horizontal blocks and intersect blocks can be stacked such that the decorative bands formed on each block create a pattern in a wall constructed from the plurality of stacked blocks.

14. The masonry system of claim 13 wherein the front wall of the vertical, horizontal and intersect blocks has an expanded thickness relative to the thickness of the back wall.

15. The masonry system of claim 14 wherein the thickness of the front wall of the vertical, horizontal and intersect blocks at the outer edge surface is approximately equal to the thickness of the back wall of each block.

* * * * *